United States Patent [19]

Pineau et al.

[11] Patent Number: 5,054,400

[45] Date of Patent: Oct. 8, 1991

[54] SEPARATING DEVICE FOR THE AERODYNAMIC BRAKING OF A BODY

[75] Inventors: Jean-Pierre Pineau; Jean-Pierre Frehaut, both of Orleans; Philippe Kerdraon, Orleans la Source, all of France

[73] Assignee: Thomson-Brandt & Armements, Boulogne, France

[21] Appl. No.: 458,734

[22] PCT Filed: Oct. 19, 1989

[86] PCT No.: PCT/FR89/00166

§ 371 Date: Dec. 1, 1989

§ 102(e) Date: Dec. 1, 1989

[87] PCT Pub. No.: WO89/09919

PCT Pub. Date: Oct. 19, 1989

[30] Foreign Application Priority Data

Apr. 12, 1988 [FR] France ..... 88 04830

[51] Int. Cl.[5] ..... F42B 10/50

[52] U.S. Cl. ..... 102/489; 102/388; 102/393; 102/400

[58] Field of Search ..... 102/388, 386, 400, 348, 102/393, 411, 489

[56] References Cited

U.S. PATENT DOCUMENTS

| | | | |
|---|---|---|---|
| 674,509 | 5/1901 | MacMartin | 102/400 |
| 1,276,575 | 8/1918 | Ross | 102/400 |
| 2,324,678 | 7/1943 | Clark | 102/400 |
| 3,114,315 | 12/1963 | Trump | 102/388 |
| 3,115,831 | 12/1963 | Suter | 102/388 |
| 3,572,250 | 3/1971 | Kriesel et al. | 102/400 |
| 3,710,715 | 1/1973 | Hoofnagle | 102/386 |
| 3,834,311 | 9/1974 | Mawhinney et al. | 102/400 |
| 4,008,667 | 2/1977 | Look | 102/400 |
| 4,648,321 | 3/1987 | Lusk | 102/388 |
| 4,699,062 | 10/1987 | Lewis et al. | 102/378 |
| 4,798,143 | 1/1989 | Graham | 102/400 |
| 4,854,241 | 8/1989 | Synofzik et al. | 102/386 |
| 4,860,660 | 8/1989 | Synofzik et al. | 102/386 |

FOREIGN PATENT DOCUMENTS 0275370 7/1988 European Pat. Off. .

*Primary Examiner*—David H. Brown
*Attorney, Agent, or Firm*—Roland Plottel

[57] ABSTRACT

A projectile with rear and front sections able to deliver payloads of submunitions contained inside the projectile after separation of the rear from the front section. The rear section is fitted with an assembly of thin blades. When both sections are assembled, the blades are partially in the rear section and partially in the front section, and when the two sections are separated, the blades spread out. The assembly is such that the length of blade that spreads out is greater than the length of blade that was in the front section before separation of the two section.

5 Claims, 10 Drawing Sheets

4"
17
21
20
16
0'
0
18
19
15
1"

SEPARATING DEVICE FOR THE AERODYNAMIC BRAKING OF A BODY

The invention relates to a separating aerodynamic braking device applicable in particular to the base or rear section of a projectile having a fast rotational motion. This device is deployed on the trajectory of a carrying projectile at a certain distance from the ground and provides the braking of this body.

The principal application of this device can be carried out on a projectile containing payloads and whose release is carried out by the separation of the forward section and the rear section, held in contact in particular by a pin system, by means of the action of propulsion gas located at the front of the projectile; this separation having taken place, the rear section of the projectile under the effect of aerodynamic forces tends to remain in the vicinity of the payload and thus risks causing problems during subsequent sequences: possibility of collision with the payload travelling in front of it . . . In order to avoid this phenomenon, it is necessary to increase the aerodynamic drag of the rear section of the projectile, preferably accompanied with an impulse to initiate the separation.

It is known to achieve the braking of the rear section of the projectile by means of a parachute; the latter is positioned inside the projectile before the phase of separation of the two sections, front and rear, of the projectile and is attached to the rear section by straps strong enough to resist the forces produced on them. The disadvantages of this type of device are on the one hand the size of the rear section of the projectile which requires a large housing in order to position the parachute and, on the other hand, the fact of using a parachute, in each projectile launched, considerably increases the cost price of the projectile.

Furthermore, another device which is used for the braking of the rear section of a projectile is a device comprising a braking element constituted from a cloth or a sheet of plastic material placed inside a cavity located in the rear section of the projectile and attached to the latter by fixing means. The deployment of this braking element is caused by the rotation of the rear section. The disadvantages of this type of device are, on the one hand, the size of the rear section of the projectile which thus limits the number of sub-munitions located inside the projectile and, on the other hand, its inefficiency in braking projectiles having a low speed of rotation.

The principal object of the invention is on the one hand to separate two bodies and, on the other hand, to brake one section at least of a mobile element while overcoming the above disadvantages.

The object of the invention is a device for separating at least two bodies having a rotational motion, characterized in that thin blades made from a material providing plastic deformation, integral with at least a first body, are fixed by one of their ends to the periphery of this said body by a fixing system in such a way as to be disposed, before separation, at the periphery of the said body and, during the separation, is deployed under the effect of centrifugal and aerodynamic forces ensuring the separation of the two bodies and the braking of the first body.

The invention and its characteristics will be better understood on reading the following description of a particular embodiment given with reference to the appended figures in which.

FIG. *7a* and *7b* are diagrams of the deployment of the thin blades according to the invention.

Figure 8:
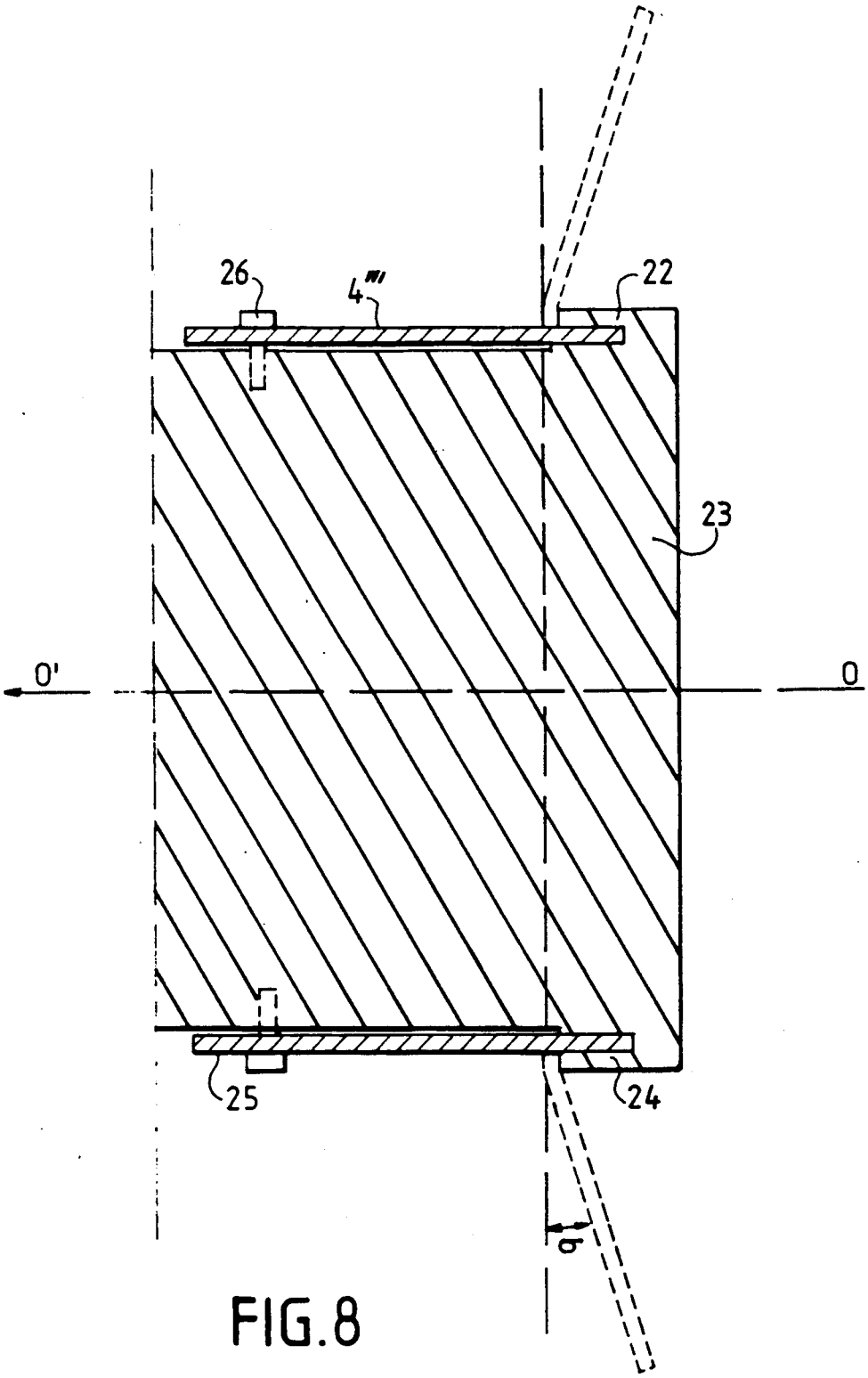
Figure 9:
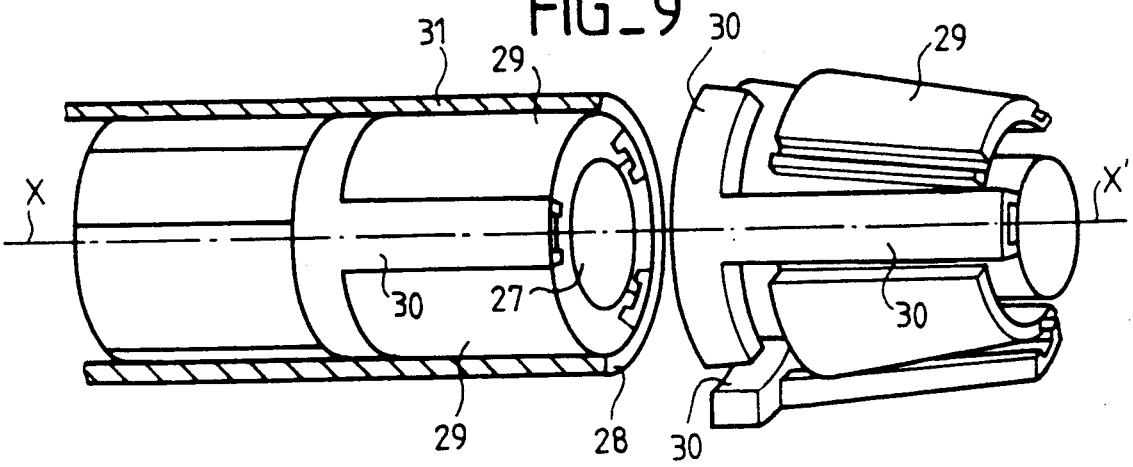
Figure 10:
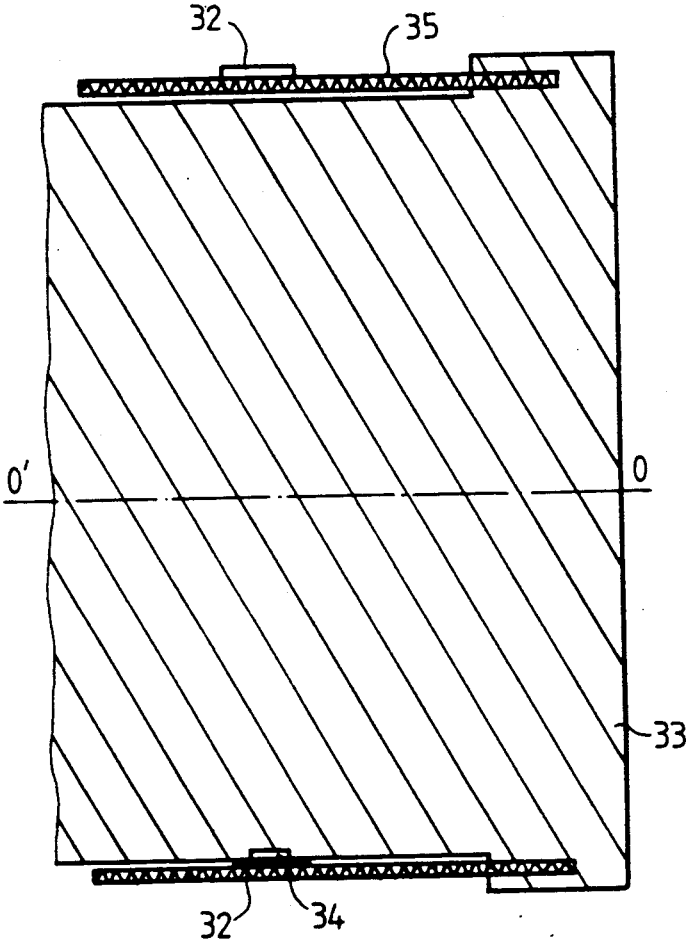

FIG. 8 is a diagram of the application of the device to a body according to the invention, FIG. 9 shows a system of holding sub-munitions inside a projectile before and after the release;

FIG. 10 is a diagram of a system of slowing down during the opening of the thin blades attached to a sub-munition according to the invention.

Figure 1:
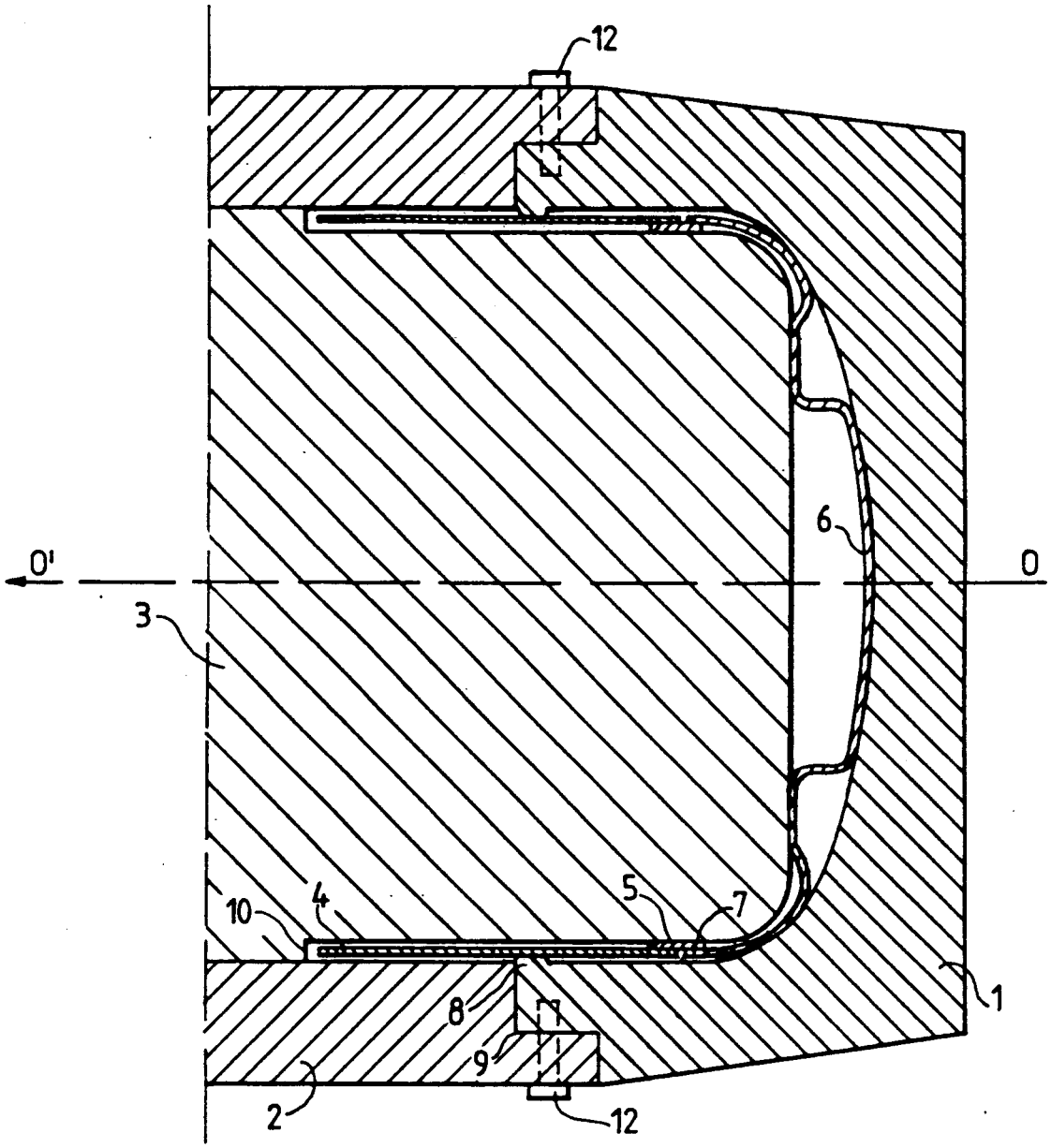
FIG. 1 is a cross-section of the rear section of a projectile before the separation phase according to the invention.

FIG. 1 is a cross-section of the rear section of a projectile before the separation phase. This projectile is provided with a braking device according to the invention. The projectile comprises a rear section 1 which may take the form of a pot, a front section 2, a payload 3, a sliding tube 5 on which are fixed the thin blades 4 and a support piece 6. The rear section 1 of the projectile is mounted, for example, in the front section 2 of the latter in the seating 9 shown in this figure. The two sections 1 and 2 are held in contact with each other by means of pins 12; it is at this point that the separation of the front section 2 of the projectile from the rear section 1 takes place. This separation is initialized, for example, by means of the impulse caused by a gas generator located in the front section 2 of the projectile and not shown in the figure and causing the breaking of the pin 12 thus freeing the front and rear two sections of the projectile and the payloads contained inside the latter. In order to enable the insertion of the thin blades 4 inside the structure of the projectile, an increase 10 in the clearance between the payload 3 and the front section 2 has been produced. These thin blades 4 are disposed side by side inside the projectile thus forming a tube which can slide; they are also fixed at one of their ends to a sliding tube 5 on which is placed a support piece 6; the shape of the latter is determined, for example, in such a way as to include raised portions serving to support the bottom of the payload 3; it is produced, for example from pressed sheet steel and its thickness is determined, for example, as a function of the strength of the materials in such a way as to prevent any distortion. At each of its ends the support piece 6 is provided, for example, with one or more lugs 7 which, during the ejection, buttress against a shoulder 8 which is an integral part of the rear structure 1 of the projectile and enabling the thin blades 4 to fulfil their function completely; these lugs 7, are produced, for example, in such a way that they move aside elastically during the fitting into the projectile when they pass at right angles to the shoulder 8; they can also be fixed, for example, to the thin blades(4) or to the sliding tube (5) while retaining their function.

Figure 2:
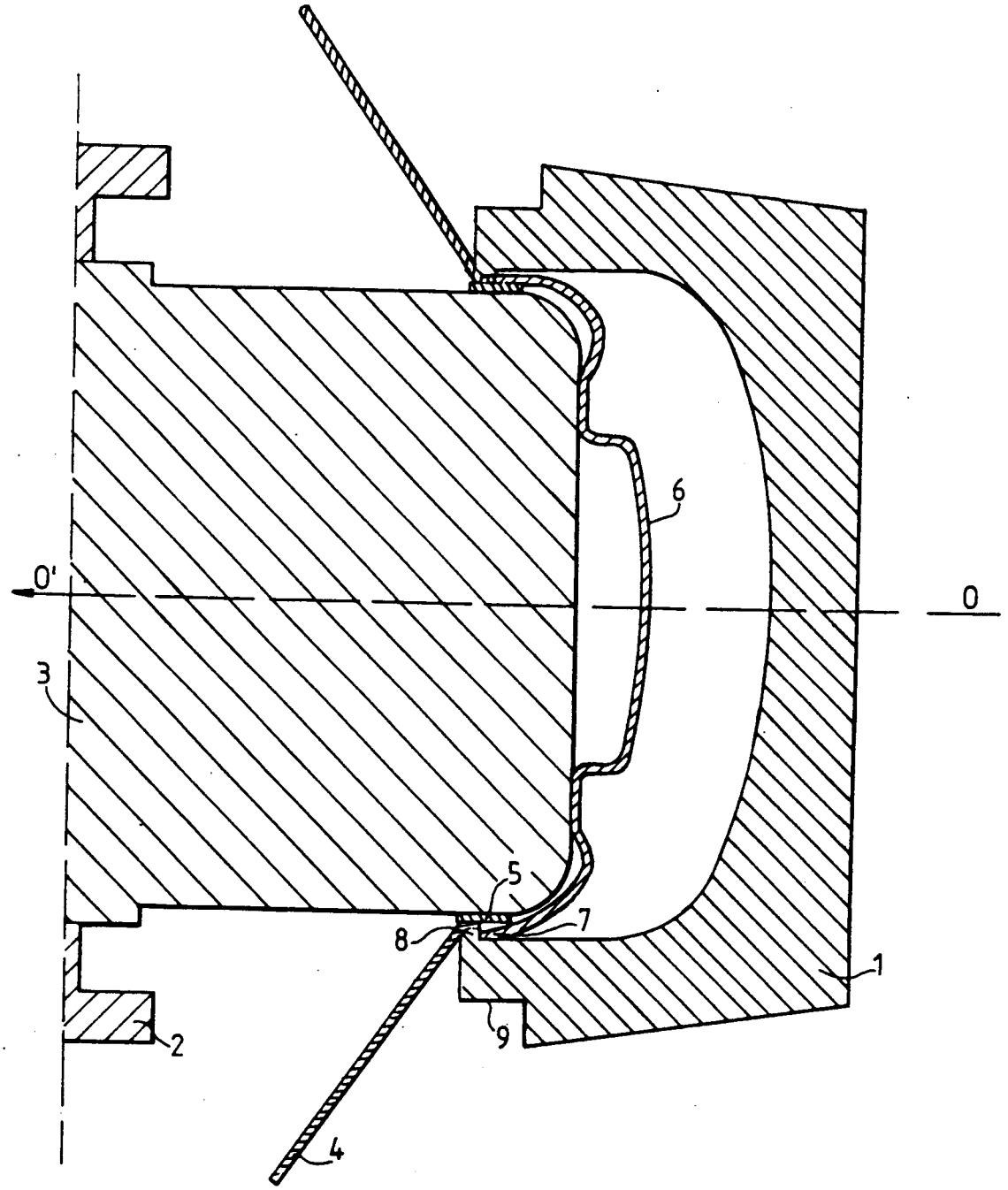
FIG. 2 is a cross-section of the rear section of a projectile during the separation phase according to the invention.

FIG. 2 is a cross-section of the rear section 1 of the projectile during the separation phase. In effect, when the projectile has left its launcher tube, it has a rotational motion about the axis 00'. The separation of the front section 2 of the projectile and its rear section 1 causes the release of the payloads contained inside the projectile. The front section 2 of the projectile is propelled forwards by means of propulsive gases; the latter apply a force to the rear of the projectile facilitating, for example, the separation of the two sections 1 and 2 of the projectile. As the separation progresses, the thin blades 4 are submitted to centrifugal force because of the rotation of the projectile. They thus apply a force which causes the start of separation between the rear section 1 and the payload 3. This phenomenon is obtained by the sliding of the assembly 4, 5, 6, along the rear section 1 of the projectile. In this way a length of deployment which is greater than that permitted by the seating between the rear section 1 and the payload 3 is enabled. The sliding of this assembly 4, 5, 6 continues up to the shoulder 8 of the rear section 1 where the lugs 7 of the support piece 6 lock the assembly 4, 5, 6.

Figure 3:
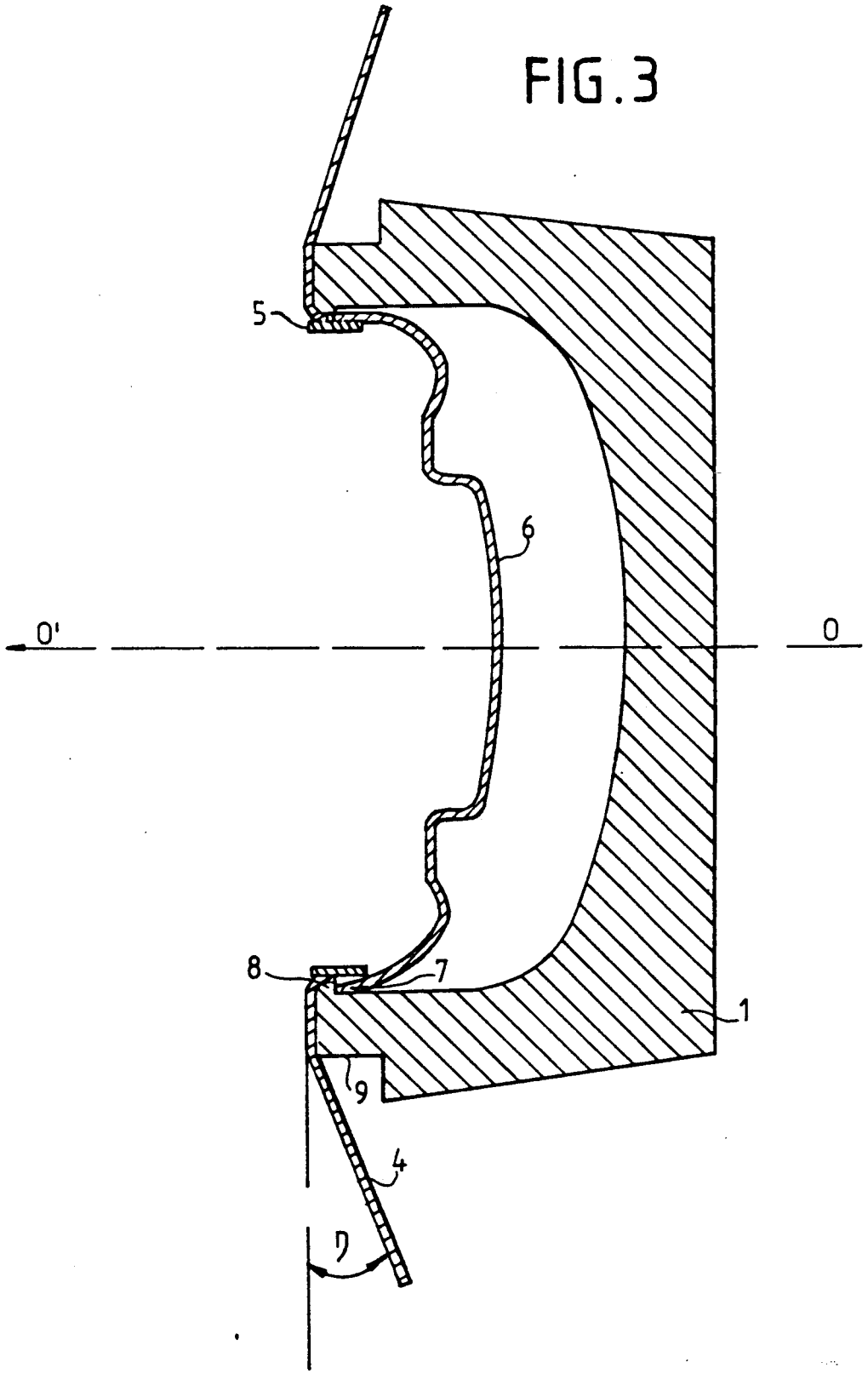
FIG. 3 is a cross-section of the rear section of a projectile after the separation phase according to the invention.

FIG. 3 is cross-section of the rear section of the projectile after the separation phase. The device according to the invention having come to a stop against the shoulder provided for this purpose, the thin blades 4 are submitted to centrifugal force because the projectile has been put into rotation during its launch phase; they are deployed in a fan shape, by flexion, as shown in FIG. 3, the velocity of the projectile also producing effects on the latter. The combined effects of the aerodynamic forces due to the velocity of the projectile and of the centrifugal forces on these thin blades 4 position them, for example, according to an angle$\eta$; this angle$\eta$ once achieved, varies little or not at all due to the structure of the thin blades made, for example, from a metallic or plastic material providing a plastic deformation, i.e. a deformation which is retained after the action of the combined effects on the thin blades This principle enables a considerable increase in the aerodynamic drag of the rear section 1 of the projectile.

Figure 4:
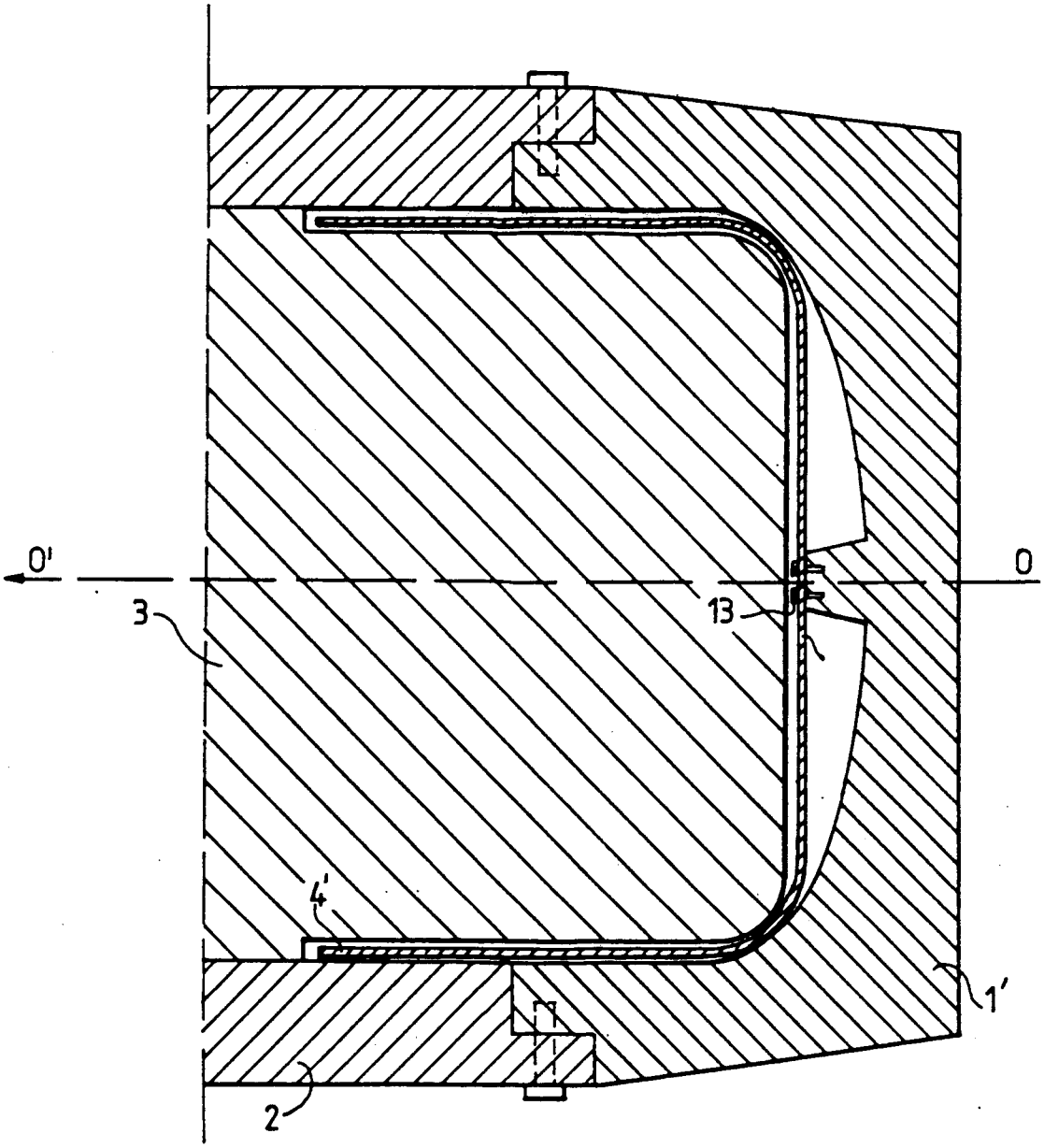
FIG. 4 is a cross-section of the rear section of a projectile before the separation phase according to another embodiment than that of the invention.

FIG. 4' shows a fixing of the thin blades 4 according to another embodiment before the phase of separation of the front section 2 of the projectile and its rear section 1'. The thin blades 4' are disposed side by side inside the projectile; they are housed between the rear section of the payload 3 and the rear section 1' of the projectile; they are fixed at one of their ends 12, for example, by a fixed fixing system, for example rivets 13 which pass through the thin blades 4' and attach to the rear section 1' of the projectile, can be used.

Figure 5:
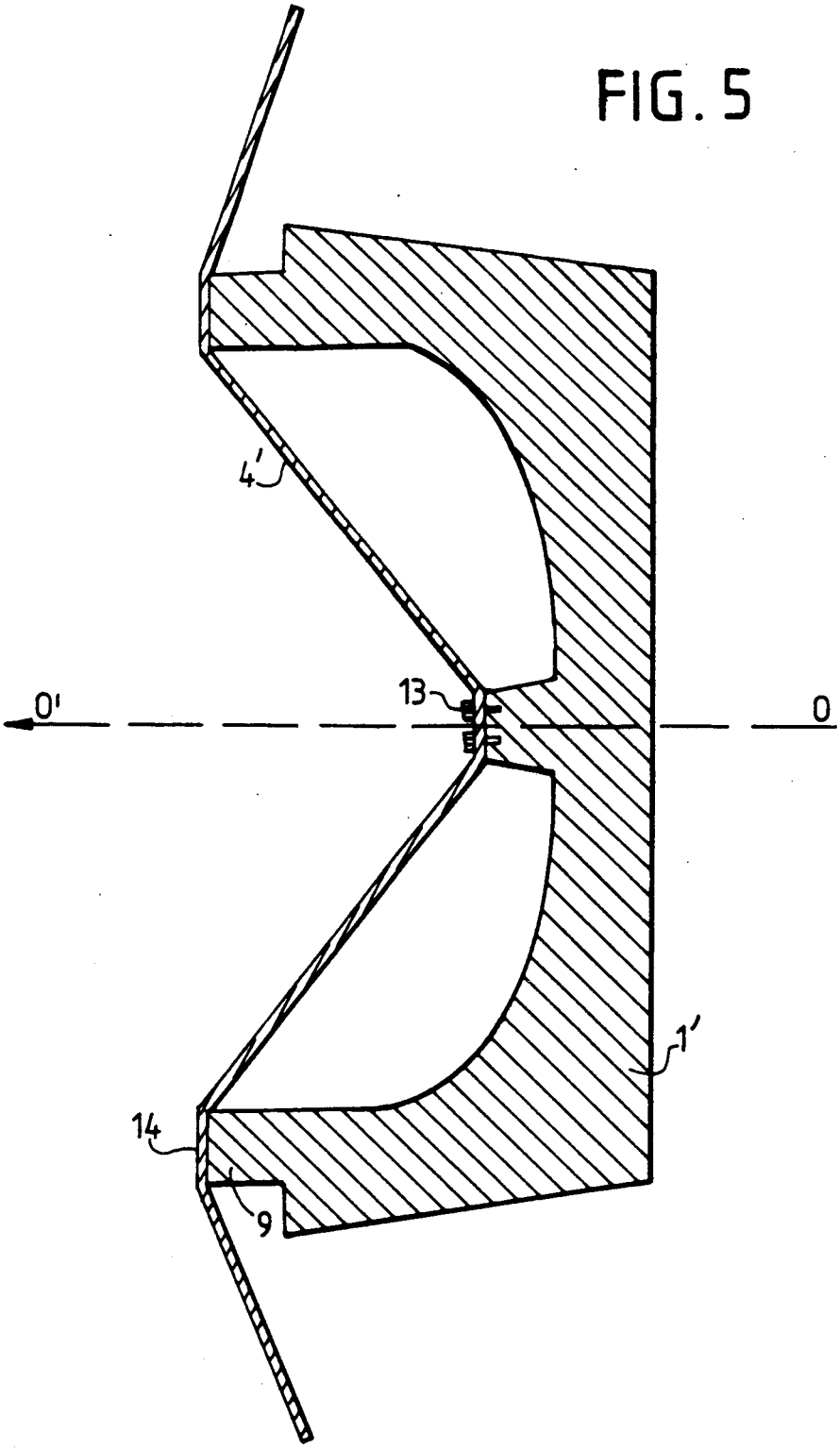
FIG. 5 is a cross-section of the rear section of a projectile after the separation phase according to the device in FIG. 4.

FIG. 5 shows the fixing system, previously described with reference to FIG. 4, after the separation of the front section 2 of the projectile and its rear section 1'. Thin blades 4' fixed to the rear section, during the ejection of the front section 2 of the projectile, deploy and take up the position shown in FIG. 5. The non-fixed end 14 of the thin blades 4' bears on a seating 9 of the rear section 1'; it is at this moment that the thin blades 4' begin to fulfil, on the one hand, their separation function by means of the action of auto-rotation forces on the thin blades which gives rise to the creation of a thrust force on the rear section 1', thus facilitating the separation of the front section 2 and the rear section 1', and on the other hand, their braking function thus enabling the distancing of the payload 3 contained inside the projectile with respect to its rear section 1.

Figure 6:
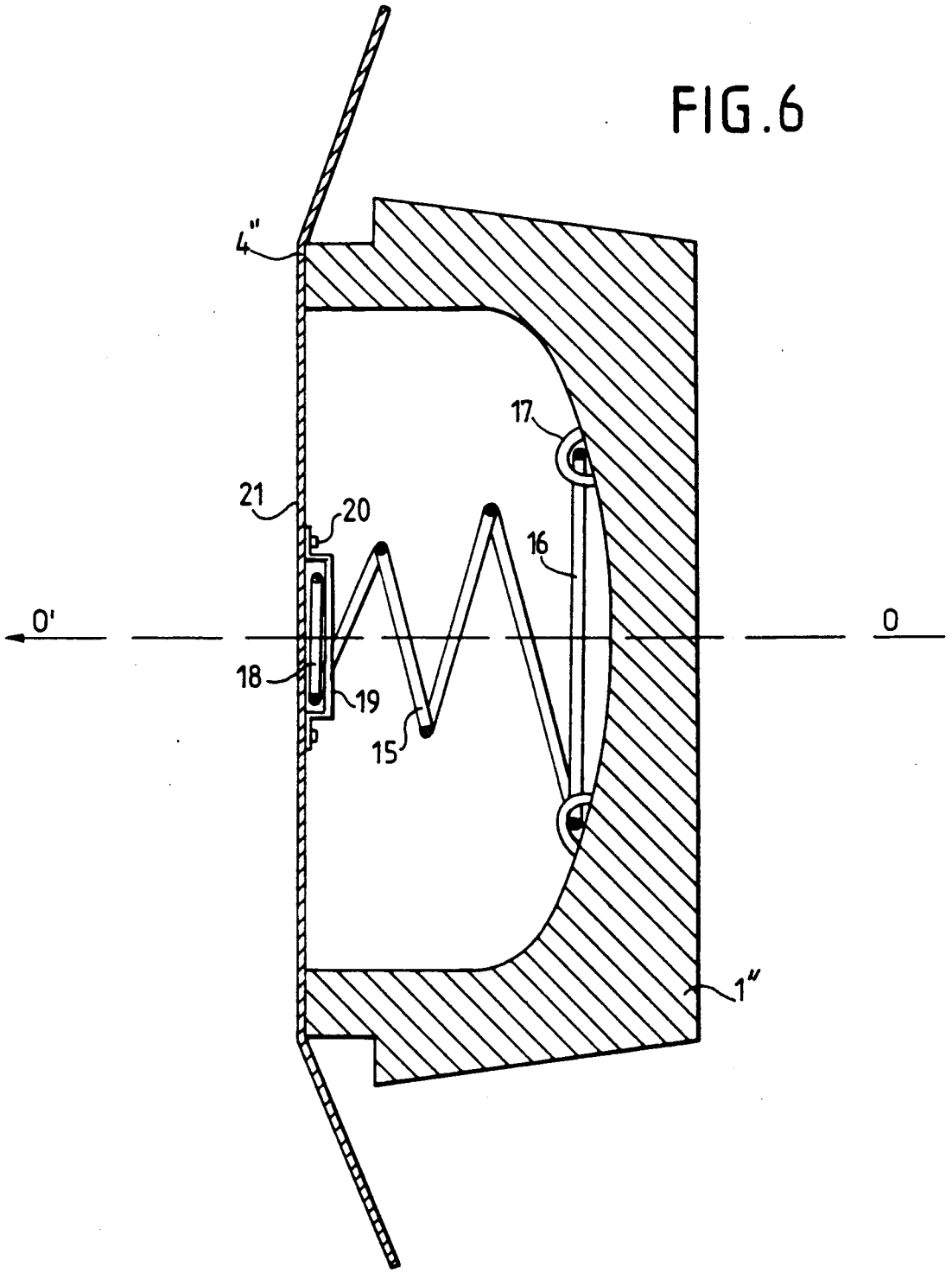
FIG. 6 is a cross-section of the rear section of a projectile after the separation phase according to another embodiment.

FIG. 6 shows a fixing of the thin blades 4' according to another embodiment after the phase of separation of the front section 2 of the projectile and its rear section 1'. The thin blades 4' have the same disposition as in the previous description; the difference resides in the fixing system; they are fixed, for example, to a mobile fixing system, for example an axially sliding fixing which can be produced, for example, by a spiral spring 15 whose largest turn 16 is fixed to the rear section 1' of the projectile, for example by attachment points 17; the central turn 18 is fixed to the thin blades 4, for example by a plate 19 provided with two rivets 20. During the ejection of the front section 2 of the projectile, the central turn 18, which is above the largest turn 16, displaces longitudinally along the direction 00' and stabilizes in the position shown in FIG. 6 in such a way that a section 21 of the thin blades 4' is in a plane perpendicular to the central turn 18 and thus to the direction 00'. The thin blades 4' then fulfil the function which has been described previously.

Figure 7A:
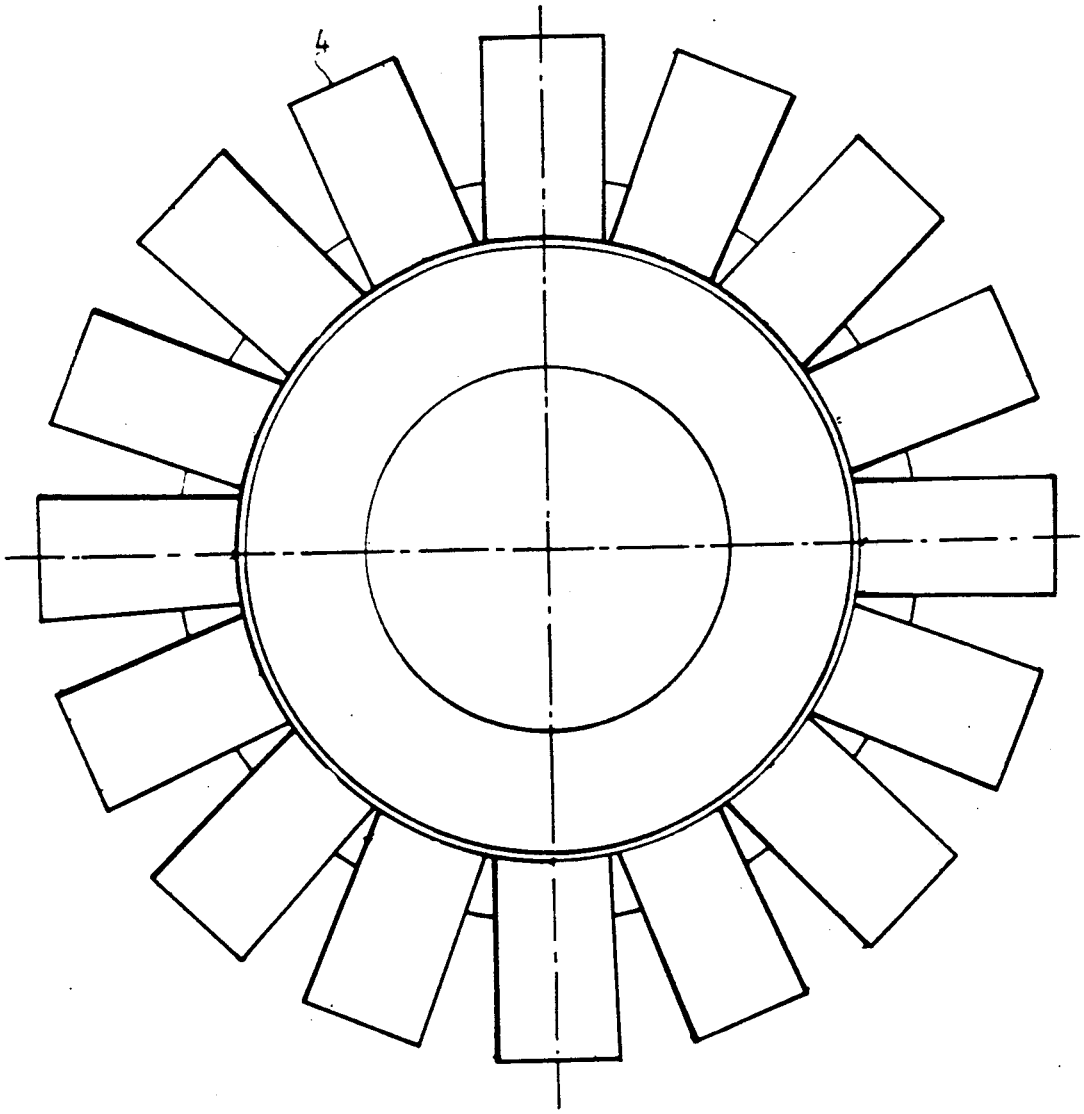
Figure 7B:
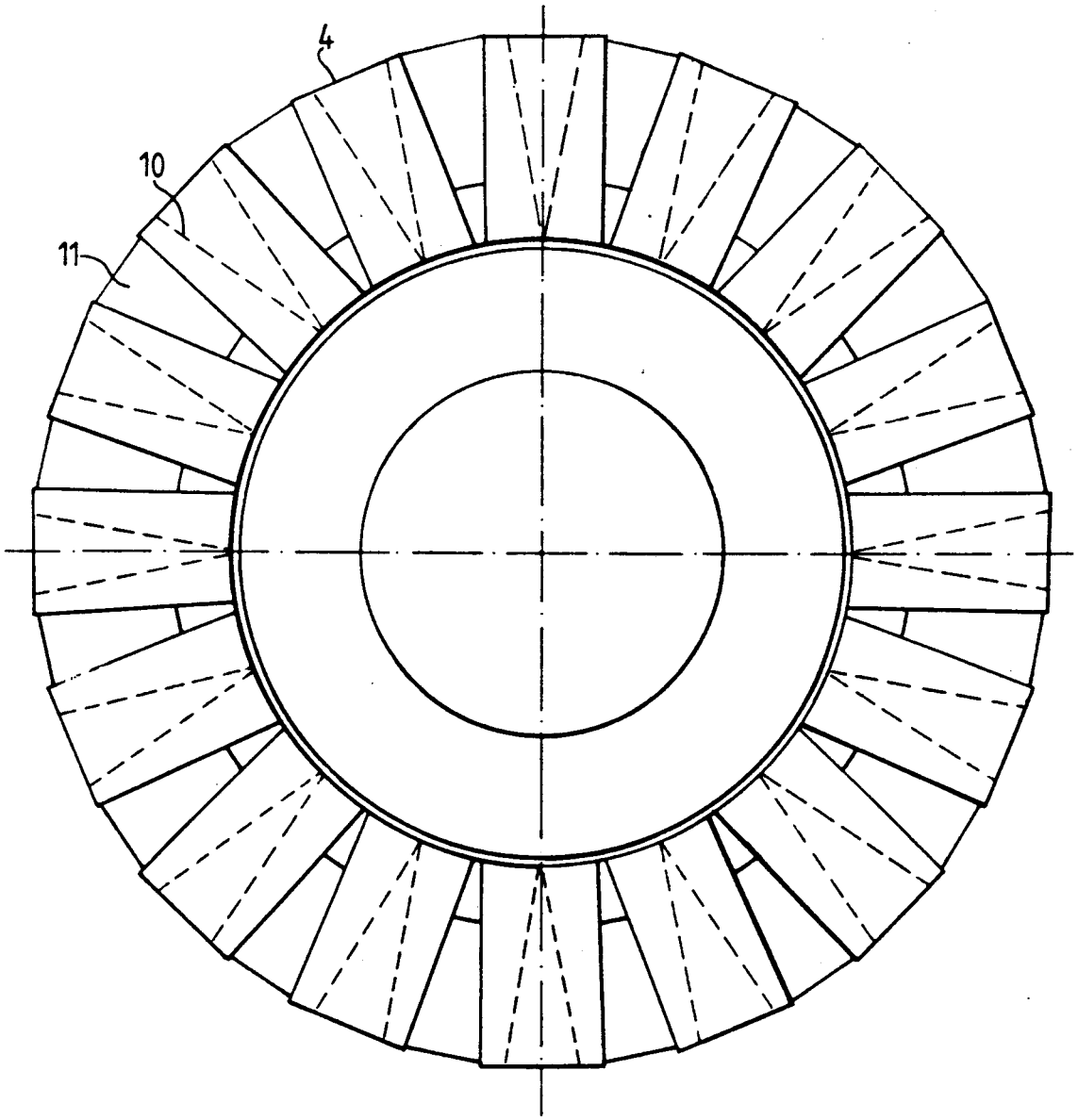

FIGS. 7*a* and 7*b* show the deployment of the thin blades 4 according to the invention. FIGS. 7*a* and 7*b* are applicable to all embodiments. Thus, it should be understood that the legend 4 when used with the diagrams of these figures is applicable not only to the blade 4 of FIGS. 1–3, but also to the blades 4', 4'', and 4''', of FIGS. 4, 5, and 8, i.e. to all the blades of the invention. Of course, additional blade arrangements to FIGS. 7*a* and 7*b* might be used with the invention. These thin blades 4 are disposed either in a layer which, in this case, causes a fan-shaped deployment of the latter as shown by the thin blades 4 drawn in solid lines in FIG. 7*a*, or in several layers, which enables the obtaining of a continuous ring deployment. In the example shown in FIG. 7*b*, two layers of thin blades have been used: the first being shown in solid lines 4, the other 10 in dotted lines. The two sets of thin blades each forming a tube in the rest state inside the projectile are offset by a certain angle in order to obtain the greatest possible braking area; the latter is obtained when the spaces 11 between the thin blades 4 of the first thickness are covered by the thin blades 7 of the second thickness. The shaping of these thin blades is given by the rotational motion of the projectile acquired at launching. The thin blades 4 are located beside each other and form a tube inside the projectile when they are distributed around the payload 3. They are relatively thin and are made, for example, from metallic or plastic material. The shape of these thin blades 4 is for example, that of a flat rectangle whose width and length give their orientation which is defined by the length/width ratio; the latter can be reduced in order to limit the risks of vibration due to the fact that the aerodynamic profile of the thin blades is unstable at large incidence For the same purpose, it is possible for example to offset the centre of aerodynamic thrust of the thin blades 4. This can be achieved, for example, by cutting out, by weighting, and by bending one of the edges of the latter; in this way, there is obtained a stable angular setting with respect to the rotation and a roll moment modifying the roll law of the braked section by making use of the energy from the axial motion which contributes to increasing the efficiency of the device.

The device functions without the use of an extractor system and suffers only interferences due to its surroundings. It can even be employed in the case in which, for example, the payload 3 of the projectile has airbrakes fixed to its rear section and opening under the influence of centrifugal force; the latter, during the insertion inside the projectile before the separation and launching phase, can bear on the sliding tube 5 which prevents them from rubbing on the rear section 1 during the sliding of the assembly 4, 5, 6 over the latter 1. Because of this, the release path with friction of the airbrakes is considerably reduced.

FIG. 8 shows another application of the braking device with thin blades according to the invention. In this figure, the thin blades (4''') are positioned, at one of their ends (22) on a body (23) for instance of payload 3 for example by inserting the latter into the structure of the body in such a way that, during the deployment of the thin blades (4'''), as shown in the figure, each of them comes to bear on the edge (24) of the considered body to enable them to fulfil their function completely, namely: the body being put into rotation, the aerodynamic effects due to the velocity of the projectile and the centrifugal forces applied to the thin blades, the thin blades position themselves according, for example, to an angle $\sigma$ considerably increasing the aerodynamic drag and therefore braking the body. The thin blades (4''') are fixed at the other end (25) by a system of pins (26) which enables the thin blades to be held in contact with the body in order firstly to increase the penetration of the body in the air and secondly to reduce the size; this system of fixing the ends (25) of the thin blades (4''') in order to position the thin blades (4''') along the body, can be carried out in particular using a control system providing for the unlocking of the fixing system at a previously computed precise instant. During the trajectory of the body, the aerodynamic forces acting on a pull out tip constituted, for example, by pins, the latter are freely pulled out leaving the thin blades (4''') to deploy and thus fulfilling their braking function.

The disposition of the thin blades (4) described in FIG. 7 and any other method of fixing the thin blades on a body can be envisaged in the application of the braking device which has just been described above.

This device according to the invention applies to any body having a high velocity of rotation and remains efficient for velocities of rotation which reduce, as once deployed, the device remains substantially in this position.

The invention can be applied in particular to any braking of a body in replacement of a braking stage and to pyrotechnic devices, for example military payloads such as illuminants or infrared illuminators which must be braked before the start of their operational phase.

The invention can also apply to sub-munitions loaded into a projectile. In effect, in order to disperse each sub-munition after ejection from the projectile, the device according to the invention can be fixed to each sub-munition in order to brake and therefore to separate these sub-munitions. In order to do this, each submunition must be provided with thin blades whose number and dimensions are determined in order to give the submunitions different velocities With reference to FIGS. 9 and 10, the application of the device, according to the invention, to sub-munitions contained inside a projectile is as follows: In FIG. 9, each sub-munition 27 placed inside the projectile 28 is covered by a compact system, in this case spacers 29, and their fixing system, for example fly-weights 30 in order, on the one hand, during the ejection to avoid causing large radial stresses against the envelope 31 of the projectile due to the centrifugal force created by the projectile rotating about its longitudinal axis and, on the other hand, to resist the mechanical stresses due to acceleration and imposed on the projectile at the launch of sufficient strength to damage certain sub-munitions. The device according to the invention must be disposed, for example, on each sub-munition, i.e. between the compact system and the sub-munition. Any other means of fixing of the thin blades on the body of the sub-munition can be used. In order to prevent a collision between the spacers and the thin blades which would cause, in particular, the destruction of the thin blades, a system for delaying the opening of the thin blades 35 has been produced; this system as shown in FIG. 10 consists, for example, in placing as many metal strips called foils 32 as there are spacer elements (not shown). These foils 32, for example made from thin sheet are wound around the sub-munition 33 in the direction opposite to the rotation with a winding angle limiting the risk of collision: this winding angle is a function of the number of spacer elements and the position of the junction between two spacer elements with respect to the fixing of the foil, for example, on the sub-munition, for example, by welding 34 at one of its ends. For example, for three spacer elements at 120°, each foil is wound around the sub-munition with a winding angle in the order of 285°. The fixing of the foil to the sub-munition is made in such a way that the tangential attachment strength is significant while the radial attachment strength is weaker such that the foil fixed, for example, by welding, does not resist the centrifugal force which causes the ejection of the latter.

We claim:

1. A projectile having a longitudinal axis 00' comprising a front part and a rear part and carrying a pay load housed along axis 00' a sub-assembly having blades and residing in a first position and in a second position, which blades when in the first position form a tube whose axis is 00', with a part of the tube being inside the rear part and another part being outside the rear part; and which blades when in the second position forms an angle with axis 00' and which has a greater part of said blades outside the rear part, means for sliding the blades whose movement from the first position to the second position is along axis 00', and means for retaining the sub assembly to the rear part when in said second position.

2. A projectile having a longitudinal axis 00', and comprising a front section, a rear section, and carrying payloads housed along said axis 00', the front section being able to be detached from the rear section to free the payloads, the rear section having the form of a pot having a free-board, a hollow part of the pot extending from the free-board being an inside of the rear section, said rear section being fitted with a sub assembly comprising blades made from a material providing plastic deformation being mounted in a circle on the rear section, the blades being able to take two positions, a first position when the rear section is still assembled with the front section of the projectile and a second position when the rear section is detached from the front section, and when in the first position at least a part of each blade forms with the corresponding parts of the other blades a tube having an axis co-axial with said longitudinal axis 00' with a part of the tube being inside the rear section and an other part of the tube being outside the rear section, and when in the second position at least a part of each blade forms with the corresponding parts of the other blades a fan, each blade bent on the free-board of the rear section with a part of each blade which is outside the rear section in the second position being greater than the part which was outside when the blades were in their first position.

3. A projectile according to claim 2 wherein the sub assembly includes means for retaining one end of the blades to the rear section.

4. A projectile according to claim 2 wherein said sub assembly comprises a sliding tube on which are attached the blades and a support piece and when in said first position the sliding tube is maintained at a rear area of the rear section by the support piece and the payload that rest on this support piece and when in the second position the sliding tube is in a front part of the rear section.

5. A projectile according to claim 4 wherein the support piece is fitted with lugs that buttress in the second position against a shoulder of the rear section.

* * * * *